United States Patent [19]

Tate

[11] Patent Number: 4,998,569

[45] Date of Patent: Mar. 12, 1991

[54] SINGLE-LAYER PAPERMAKING BROKEN-TWILL FABRIC AVOIDING WIRE MARKS

[75] Inventor: Takuo Tate, Tokyo, Japan

[73] Assignee: Nippon Filcon Co., Ltd., Tokyo, Japan

[21] Appl. No.: 399,216

[22] Filed: Aug. 29, 1989

[30] Foreign Application Priority Data

Aug. 30, 1988 [JP] Japan ..... 63-213684

[51] Int. Cl.[5] ..... D03D 13/00

[52] U.S. Cl. ..... 139/383 A; 162/DIG. 1

[58] Field of Search ..... 162/DIG. 1, 348, 358; 428/257; 139/383 A, 425 A

[56] References Cited

U.S. PATENT DOCUMENTS

| | | | |
|---|---|---|---|
| 3,143,150 | 8/1964 | Buchanan | 139/383 A X |
| 4,105,495 | 8/1978 | Pai | 162/348 |
| 4,112,982 | 9/1978 | Bugge et al. | 139/383 A X |
| 4,184,519 | 6/1980 | McDonald et al. | 139/425 A |
| 4,423,755 | 1/1984 | Thompson | 139/383 A |
| 4,592,395 | 6/1986 | Borel | 139/425 A |
| 4,776,373 | 10/1988 | Borel | 139/383 A |
| 4,821,780 | 4/1989 | Tate | 139/383 A |

FOREIGN PATENT DOCUMENTS 44-22544 9/1969 Japan .

*Primary Examiner*—Andrew M. Falik

*Attorney, Agent, or Firm*—Beveridge, DeGrandi & Weilacher

[57] ABSTRACT

In a papermaking single-layer broken-twill woven fabric having a running surface formed of long crimps of wefts, auxiliary wefts having a smaller diameter than primary wefts are disposed between primary wefts. The auxiliary wefts are disposed over warps at locations where one of two adjacent warps located between the two wefts intersect by extending from either the paper-side or from the running side of the preceding primary weft toward the opposite side of the succeeding primary weft. Every auxiliary weft which is woven into the texture at least once in a repeating unit, thereby forms a flat papermaking surface.

12 Claims, 7 Drawing Sheets

SINGLE-LAYER PAPERMAKING BROKEN-TWILL FABRIC AVOIDING WIRE MARKS

BACKGROUND OF THE INVENTION

The present invention relates to a papermaking fabric.

In the conventional papermaking process carried out by using a fourdrinier wire screen, a slurry of raw material is supplied onto an endless papermaking fabric or cloth running continuously. The papermaking cloth separates cellulosic fibers from the slurry to thereby form a moist paper web thereon. From this viewpoint, it may be regarded that the papermaking cloth functions as a filter for forming the moist paper web. Most apertures of the cloth also referred to as the drain orifices serve for separating water from the slurry. Further, in the case of a fourdrinier machine, the papermaking cloth serves also as a driving belt and is thus subjected to a tension exerted by the machine. In view of this, it is required that the papermaking cloth should exhibit an enhanced stability.

Among the several requirements imposed in connection with the papermaking cloth or fabric, the following are to be noted among others. Namely, the papermaking cloth is required to exhibit a high retention capability of retaining paper material with a minimum flow loss, no generation of wire marks, a high drainage capability with a reduced water retaining capacity, a high capability of abrasion resistance and an enhanced runability.

With a view to satisfying the above requirements imposed on the papermaking cloth, there have heretofore been made a variety of proposals. However, at the present state of the art, there is yet unavailable the papermaking cloth which satisfies the abovementioned requirements to the satisfactory extent.

By way of example, the finely woven papermaking cloth woven made using thin yarns in an attempt to enhance the raw material retention capability while preventing formation of the wire marks suffers from such shortcomings that the runability and the abrasion resistance capability are poor. In recent years, attempts have been tried to form the cloth of the papermaking surface from the wefts for thereby improving the raw material retention capability. The papermaking surface formed from the wefts is certainly advantageous in that the cloth or fabric is improved in respect to the drainage property because of little or no possibility of the drain apertures existing between the warps being directly blocked by the paper material. It is however noted that the wire marks become more noticeable because the inter-weft gaps are increased correspondingly.

As an approach to solve the above problem, it has been proposed to increase the number of the wefts forming the papermaking surface by disposing so-called floating yarns which are not woven into the texture of the fabric in the form of interweave with the warps and the wefts. This proposal is certainly an interesting technical idea from the standpoint of increasing the number of the wefts constituting the papermaking surface of the cloth, which idea can not however be applied to practical papermaking process, because the wefts not woven into the texture, i.e. the floating yarns tend to be displaced and collected together under a hydraulic pressure applied thereto upon charging of the slurry on the papermaking cloth. The result is that the papermaking surface can not be maintained flat or uniform.

The problem of the wire marks is more noticeable in the case of the single-layer cloth in which the wefts form projections on the papermaking surface.

There has also been proposed the use of a cloth of a combination weave (multi-layer fabric) in an effort to obtain a high drainage property and a papermaking surface of a fine mesh while ensuring a high abrasion resistance capability.

Recently, there also has arisen a tendency that the papermaking process is carried out with a higher speed with a view to increasing the efficiency of the papermaking process, which however presents additional new problems. The multi-layer fabric which can certainly exhibit advantageous effects unattainable with the single-layer fabric has a high water containing property which is primarily ascribable to the multi-layer structure. By way of example, when the endless screen formed of the multi-layer fabric is driven at a high speed, there will take place such a phenomenon that water droplets are caused to spill out particularly at the rotating turn-back rolls under a centrifugal force.

In this conjunction, it is noted that the single-layer fabric is essentially insusceptible to the phenomenon mentioned above due to the inherently small water containing capacity. However, the single-layer fabric is constituted by the wefts thereby, forming juxtaposed long crimps projecting on the running surface for protecting the warps from the abrasion. In other words, the papermaking surface is formed mainly by the long crimps of warps disposed in parallel in cooperation with only a small proportion of the weft knuckles.

Since the parallel rows of the long warp crimps extending in the machine direction coincide with the direction in which the fibers contained in the flow of the raw paper material ejected from an inlet pore are oriented, the fibers tend to be deposited within the longitudinal grooves formed between the long knuckles of the warps at an early stage of the papermaking process to thereby block the drain apertures or meshes, making difficult the separation and removal of water in the subsequent papermaking process.

To avoid the abovementioned problems, such measures as slow down of papermaking speed or an enforced vacuum dehydration must be performed, which in turn will result in a rapid abrasion of the papermaking fabric and bring about various difficulties such as described hereinafter.

After studies conducted by the inventor of the present application for solving the problems associated with the requirements for a high paper material retention capability, suppression of generation of the wire marks, a high drainage capability and a low water containing capacity, a high abrasion resistance capability and an improved runability and others, it has been found that these problems cannot be solved without increasing the density of wefts on papermaking surface of the fabric for the propose of improving retention capability, that a single-layer fabric should be used instead of a multi-layer fabric which has limitations for lowering water containing capability, and that these problems can not be solved merely by changing the weave pattern of the single-layer fabric from plain weave to twill weave, satin weave or others.

Referring to FIGS. 1A and 1B of the accompanying drawings which shows a texture of 3/1 satin woven fabric which is a typical one of the single-layer broken-twill woven fabrics known heretofore, the warp 1 extending from the bottom side of the wept A to the top side of the weft B intersects a warp 2 extending from the top side of the weft A to the bottom side of the weft B at a location between the wefts A and B. In FIGS. 1A and 1B the warps (Machine Direction (MD) yarns) are designated by alphabet symbols, namely, A, B, C and D, and the wefts (Cross Machine Direction (CMD) yarns) are designated by Arabic numerals, namely 1, 2, 3 and 4. FIG. 1A shows the unity textile design charts. A symbol "X" indicates the position where the warp is located on the weft as well as the position where the weft is woven into the texture of the warp, whereas a blank box having no mark "X" indicates the position where the weft is located on the warp. FIG. 1B shows the paper-side plan view of the texture of 3/1 satin woven fabric.

Similar intersection of the warps 3 and 4 takes place between wefts C and D.

Due to the intersection of the two warps as described above, the gap between the wefts A and B as well as between the wefts C and D tend to be widened, while the gap between the wefts of B and C as well as between the wefts D and A tends to be narrowed because of absence of the intersection of the warps between these wefts.

Under the circumstances, difficulty is encountered in realizing the uniform mesh, involving non-uniform formation of the inter-weft gaps.

Additionally, it is noted that the warps 1 and 2 obliquely intersect each other between the wefts A and B to form a recess the surface of the woven fabric. The reason why such a recess is formed is, as shown in FIG. 1B, the weft A is pushed or urged toward the weft, and the weft B is pushed or urged toward the weft C, due to the force created by the intersecting warps 1 and 2. Such recess makes appearance between the wefts C and D as well. The presence of these recesses between the wefts in addition to the wide inter-weft gaps allows the fibers of the paper material to pass through the papermaking fabric to be lost uselessly (degradation in the paper material retention capability). Further, the fibers are likely to stick to the fabric (giving rise to sheet release layer from the fabric and deterioration in the surface quality of paper) and generate roughness in the paper surface (deterioration in smoothness and formation of the wire marks).

Parenthetically, the ordinary twill-woven fabric such as, for example a 2/1, 3/1 or 4/1 weave design is generally insusceptible to the occurrence of the non-uniformity in the distribution of the wefts mentioned hereinbefore. However, the wire marks tend to be noticeable in the oblique direction because of presence of the recesses in the oblique direction (twilling direction) and thus the twill-woven fabric is not suited for use as the papermaking sheet.

Besides, multi-layer twill-woven fabric exhibits a high water containing capacity because of presence of large voids, involving the problem of adhesion of water onto the paper surface and shower effect, difficulty encountered in repairing the papermaking fabric, inefficiency of the paper manufacture, heaviness and others. For these reasons, the multi-layer twill-woven fabric does not show satisfactory results.

SUMMARY OF THE INVENTION

In view of the state of the art described above, the present invention provides:

A papermaking single-layer fabric improved in respect to wire marks and constituted by a broken-twill woven fabric of more than four shafts inclusive thereof and having a running surface formed of long crimps of wefts, wherein an auxiliary weft, having a smaller diameter than the primary weft, is disposed between inherent wefts on two warps at an intersection where one of two adjacent warps located between two wefts and extending from the paper side of the preceding one of the two wefts toward the running side of the succeeding weft and the other of the adjacent warps extending from the running side of the preceding weft toward the top side of the succeeding weft intersect each other between the wefts, the auxiliary weft being woven, in each of repeating units at least once into texture.

In a more detailed aspect, the invention provides a papermaking single-layer broken-twill woven fabric, such as a 3/1 broken-twill weave, having the running surface formed of long crimps of wefts, the auxiliary weft being disposed for every two other wefts.

In a further aspect, the broken-twill woven fabric having the running surface formed of long knuckles of wefts if of 4/1 broken twill weave, and wherein three auxiliary wefts are disposed among five wefts in each repeating unit.

Another feature of the invention resides in a papermaking single-layer fabric improved in respect to wire marks wherein the broken twill-woven fabric having the running surface formed of long crimps of wefts is of 5/1 broken-twill weave, and wherein four auxiliary wefts are disposed among six wefts in each repeating unit.

In the single-layer fabric of the structures mentioned above, the auxiliary wefts are disposed between the wefts at locations where the two adjacent warps intersect each other extending from one of the running and papermaking surfaces to the other to thereby fill the recesses which will otherwise be formed in the papermaking surface at the intersections of the warps, whereby the papermaking surface presenting a flat and smooth water drainage surface, as will be described in more detail later on in conjunction with exemplary embodiments of the invention.

Since each auxiliary weft is woven into the texture of the fabric at least once in each repeating unit, there are formed a number of crimps of the auxiliary wefts in the papermaking surface of the fabric. Thus, the papermaking surface of the woven fabric according to the present invention is also characterized in that the papermaking surface is composed mainly of the auxiliary wefts each of a small diameter and the primary wefts, whereby the papermaking surface having an increased number of paper material retaining points is realized.

The woven fabric according to the invention can be made from polyamide yarns or polyester yarns. The auxiliary wefts should preferably be made of polyester or polyamide yarns. The auxiliary wefts are each disposed between the primary wefts. In this connection, it should be mentioned that more than two auxiliary wefts inclusive thereof may be disposed between the adjacent wefts so far as the fabric can maintain a single-layer surface.

Since the woven fabric according to the invention is of more than four shafts inclusive thereof, the wefts forming the running surface form the long crimps to thereby improve the abrasion resistance capability, to further advantage.

It is apparent that the inventive papermaking woven fabric or cloth of the structure described above is provided with the papermaking surface having an increased number of fiber supporting points because of presence of the auxiliary wefts disposed between the intrinsic wefts.

The structure of the fabric will hereinafter be described in more detail in conjunction with exemplary embodiments of the invention.

One of the important features of the present invention resides in that any one of the auxiliary wefts is woven in at least once into the texture. By virtue of this feature, the auxiliary wefts constitute integral parts of the fabric, whereby moving of the auxiliary wefts is prevented, and impart rigidity to the fabric to thereby enhance the runability of the fabric, to great advantage.

According to another important feature of the invention, the woven fabric is formed in the single-layer structure with void as well as the water containing capacity being decreased. Accordingly, such phenomenon that the water droplets are caused to spill out from the fabric at high speed of paper manufacture can be avoided, while the problem of generation of the wire marks due to piercing of pup fibers through the inter-warp gaps to form the fiber mat can be solved satisfactorily, whereby drainage apertures of a size sufficient to improve the drainage of water through the papermaking fabric can be assured. Additionally, an increased density of the wefts on the papermaking surface of the woven fabric contributes to improvement of the fabric with regard to the paper material retention capability while imparting an enhanced smoothness to the paper being manufactured.

The auxiliary weft employed according to the teaching of the present invention is required to have a smaller diameter than that of the primary weft. By making smaller the diameter of the auxiliary weft, the thickness of the woven fabric hand hence the voids of the woven fabric can be reduced correspondingly while ensuring a high drainage capability for the papermaking surface of the fabric.

In this way, the drawback of the multi-layer fabric in respect to the water containing capacity mentioned hereinbefore can be eliminated in a satisfactory manner.

In the following, exemplary or preferred embodiments of the present invention will be described in more detail by referring to the accompanying drawings which show in textile design charts unity textures of the woven fabrics, respectively.

Figure 1A:
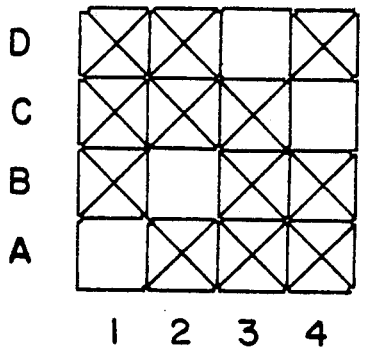
FIG. 1A is a texture chart showing a typical single-layer 3/1-broken-twill woven fabric of the prior art.

In the drawings, the warps are denoted by Arabic numerals, while the wefts are denoted by capital letters A to F, respectively. The auxiliary wefts are denoted by c to d, respectively.

Figure 5:
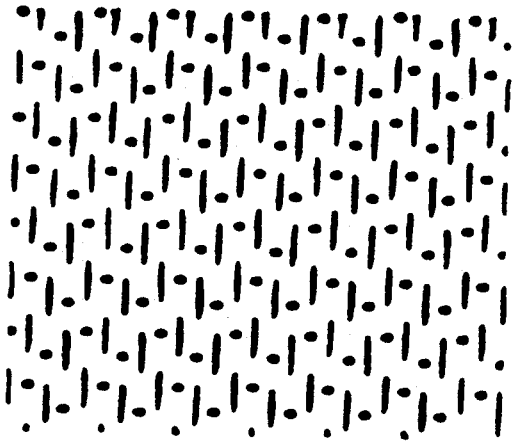
Figure 6:
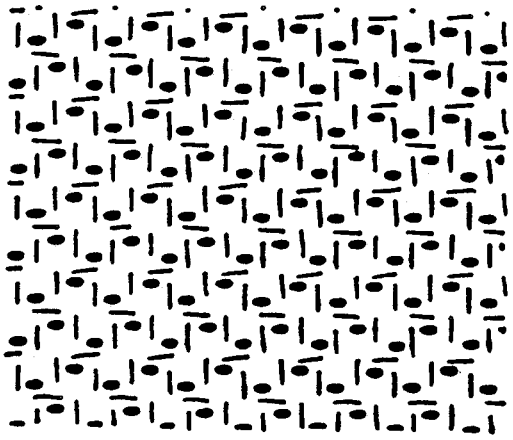

FIGS. 5 and 6 show printed marks of the knuckles formed in the papermaking surface of a woven fabric, wherein FIG. 5 shows that of the printed knuckle marks of the prior art 3/1 broken-twill fabric shown in FIG. 1A.

Figure 2A:
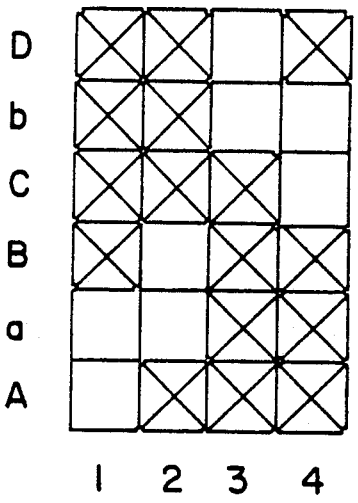
FIGS. 2 to 4 are texture charts showing typical embodiments of the single-layer fabric for the papermaking sheet according to exemplary embodiments of the present invention, respectively.
FIGS. 2B, 3B and 4B show their plan views respectively for the resultant fabric structures.
FIG. 2C is a cross-sectional view taken along the line I—I' shown in FIG. 2B.
FIG. 2D shows the plan view of the paper making fabric shown in FIG. 2A, wherein each of auxiliary wefts composed of twisting of multi-filaments.
FIG. 2E is a cross-sectional view of the fabric taken along the line II—II' shown in FIG. 2D.
FIG. 2F shows the plan view of the paper-making fabric shown in FIG. 2A, wherein a pair of auxiliary wefts are disposed between two adjacent primary wefts.
FIG. 2G is a cross-sectional view of the fabric taken along the line II—II' shown in FIG. 2F.

FIG. 6 shows a printed pattern of knuckle marks of the single-layer fabric according to an embodiment of the present invention shown in FIG. 2A.

DETAILED DESCRIPTION OF THE PREFERRED EMBODIMENTS

Figure 2B:
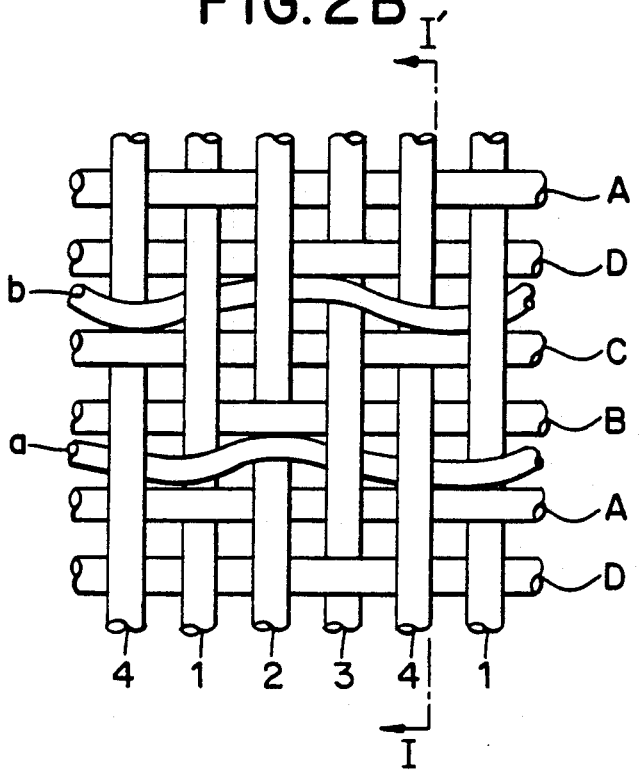

FIG. 2A shows a texture chart and FIG. 2B is a plan view both showing a 3/1 -broken-twill woven fabric according to an exemplary embodiment of the present invention in which the auxiliary wefts c and b are woven into the texture between the wefts A and B and between the wefts C and D, respectively. Note specifically, the auxiliary weft a is disposed between the wefts A and B in a recess formed at a location where the warp 1 extending from the bottom side (running side) of the weft A to the top side (paper side) of the weft B intersects obliquely the warp 2 extending from the top side of the weft A to the bottom side of the weft B, while the auxiliary weft b is disposed between the wefts C and D in a recess formed at a location where the warp 3 extending from the top side of the weft C to the bottom side of the weft D obliquely intersects the warp 4 extending from the bottom side of the weft C toward the top side of the weft D.

These auxiliary wefts (a and b) are disposed between the wefts A and B and between the wefts C and D, respectively, extend above the two wefts in the recesses formed by intersections of the warps 1 and 2 and the warps 3 and 4, respectively, and woven once into the texture by the warps 3 and 4 and the warps 1 and 2, respectively. As the result, the auxiliary weft is disposed between the two wefts. Since the auxiliary wefts are woven into fabric, they are disposed inherently in a zig-zag manner, as shown in FIG. 2A. For example, the auxiliary weft a comes closer to the weft A over the warp 1 and comes closer to the weft B over the warp 2. Likewise, the auxiliary weft becomes closer to the weft D over the warp 3 and comes closer to weft C over the warp X.

Figure 2C:
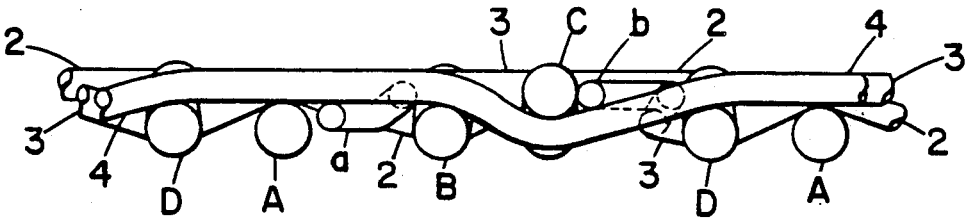

This zig-zag manner of auxiliary wefts is shown in FIG. 2C, which is a cross-sectional view of the fabric at the portion of line I—I' in FIG. 2B.

Figure 3A:
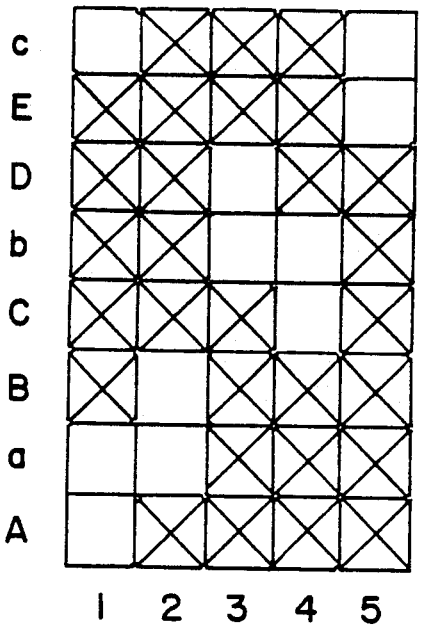
Figure 3B:
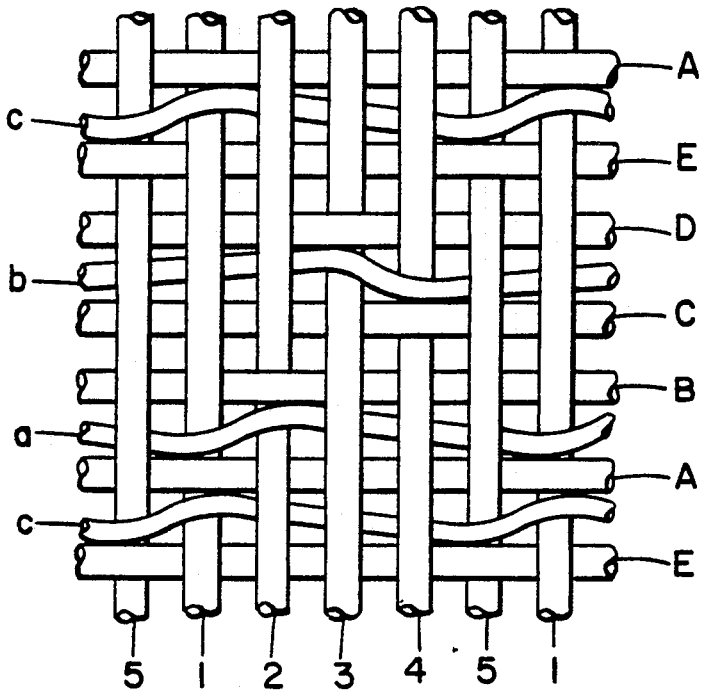

FIG. 3A is a texture chart and FIG. 3B is a plan view of a 4/1 broken-twill woven fabric in which the auxiliary wefts a, b and c are woven into the texture between the wefts A and B, between the wefts C and D and between the wefts E and A, respectively. More specifically, the auxiliary weft A is disposed between the wefts A and B on the warps 1 and 2 in a recess formed at a location where the warp 1 extending from the bottom side (running side) of the weft A to the top side (paper side) of the weft B obliquely intersects the warp 2 extending from the top side of the weft A to the bottom side of the weft B. The auxiliary weft b is disposed between the wefts C and D on the warps 3 and 4 in a recess formed at a location where the warp 3 extending from the top side of the weft C to the bottom side of the weft D obliquely intersects the warp 4 extending from the bottom side of the weft C to the top side of the weft D. The auxiliary weft c is disposed between the wefts E and A on the warps 5 and 1 in a recess formed at a location where the warp 5 extending from the bottom side of the weft B to the top side of the weft A obliquely intersects the warp 1 extending from the top side of the weft E to the bottom side of the weft A. In other words, the auxiliary wefts a, b and c are disposed between the wefts A and B, between the wefts C and D and between the wefts E and A to extend above the warps 1, 2, 3, 4, and 5 in the recesses formed in the papermaking surface by the paired warps 1 and 2, 3 and 4 and 5 and 1, respectively, and woven three times into the texture by the warps 3; 4; 5; 1: 2 and 2; 3;4, respectively. As the result, three auxiliary wefts are disposed among the five wefts.

Figure 4A:
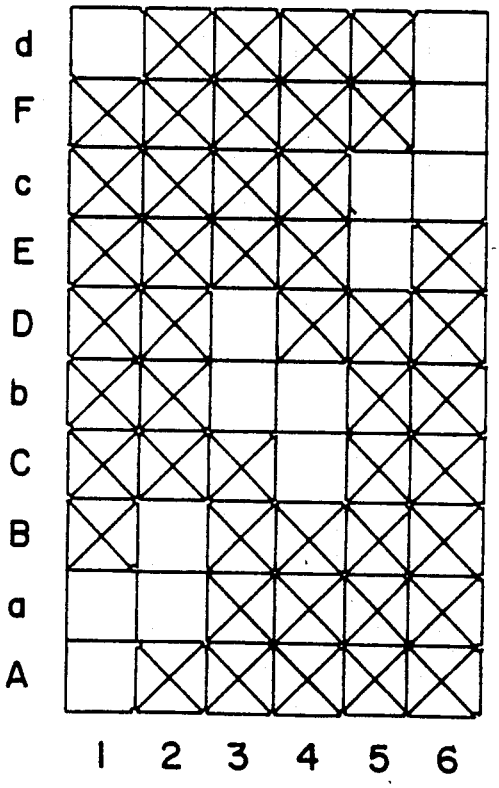
Figure 1B:
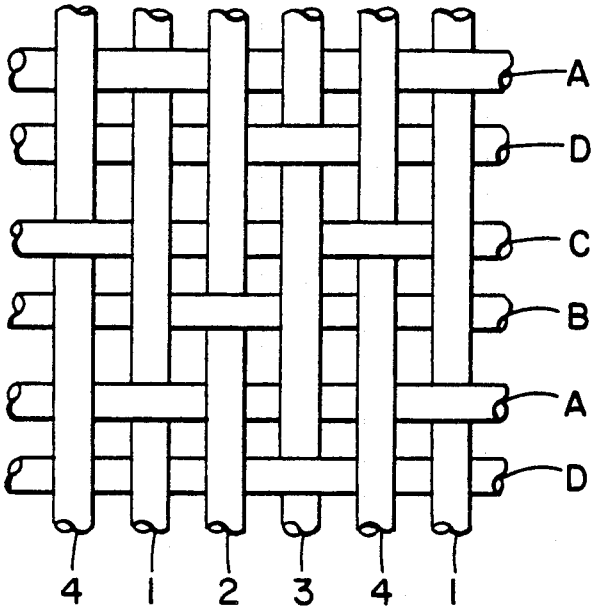
FIG. 1B is a plan view of the fabric of FIG. 1A.
Figure 4B:
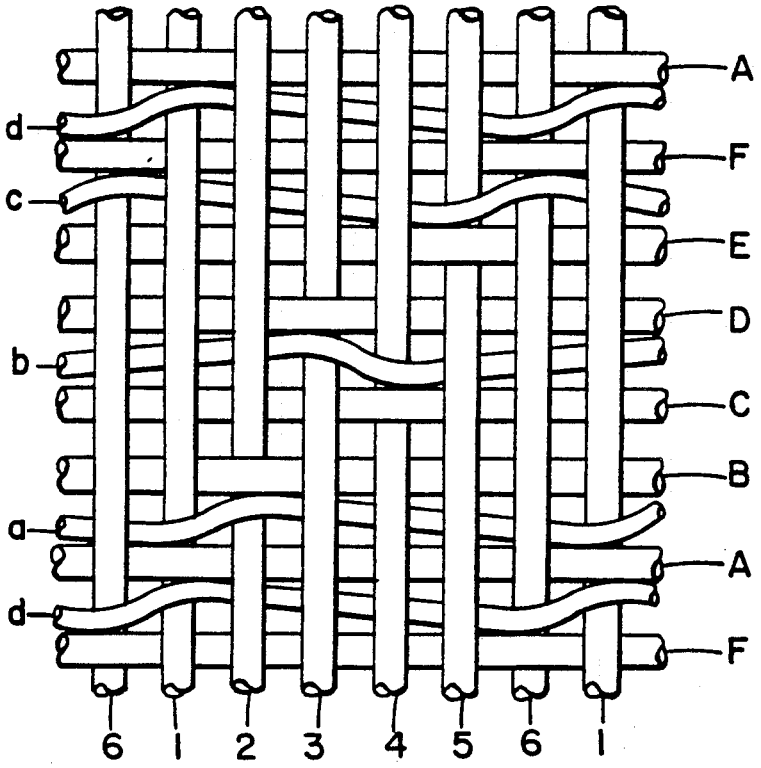

FIG. 4 is a texture chart and FIG. 4B is a plan view showing a 5/1 broken-twill woven fabric in which the auxiliary wefts a, b, c, and d are woven into the texture between the wefts A and B, between the wefts C and C, between the wefts E and F and between the wefts F and A, respectively, according to another exemplary embodiment of the present invention. More specifically, the auxiliary weft a is disposed between the wefts A and B on the warps 1 and 2 in a recess formed at a location where the warp 1 extending from the bottom side (running side) of the weft 1 to the top side B (paper side) obliquely intersects the warp 2 extending from the top side of the weft A to the bottom side of the weft B. The auxiliary weft b is disposed between the wefts C and D on the warps 3 and 4 in a recess formed at a location where the warp 3 extending from the top side to the bottom side of the weft D obliquely intersects the warp 4 extending from the bottom side of the weft C to the top side of the weft D. The auxiliary weft c is disposed between the wefts E and F on the warps 5 and 6 in a recess formed at a location where the warp 5 extending from the bottom side of the weft E to the top side of the weft F intersects the warp 6 extending from the top side of the weft E to the bottom side of the weft F. Finally, the auxiliary weft d is disposed between the wefts F and A on the warps 6 and 1 in a recess formed at a location where the warp 6 extending from the bottom side of the weft F to the top side of the weft A intersects the warp 1 extending from the top side of the weft F to the bottom side of the weft A.

In other words, the auxiliary wefts a, b, c and d are disposed between the wefts A and B, between the wefts C and D, between the wefts E and F and between the wefts F and A, respectively, on the pairs of the warps 1 and 2, 3 and 4, 5 and 6 and the pair of warps 6 and 1 in the recesses formed by these pairs of the warps, respectively, and woven into the texture by the warps 3, 4, 5 and 6, 1, 2, 5 and 6, 1, 2, 3 and 4 and the warps 2, 3, 4 and 5, respectively. As the result, four auxiliary wefts are disposed among the six wefts in the unity texture.

Although the invention has been described in conjunction with the exemplary embodiments shown in the drawings, it goes without saying that the teaching of the present invention can equally be applied to other types of broken-twill woven fabrics by disposing the auxiliary wefts correspondingly, to similar effects.

The foregoing description is directed to the textures of the single-layer papermaking fabric according to the present invention. Although the warps constituting part of the fabric according to the invention may be formed of monofilament or twisting of multi-filaments of synthetic resin as in the case of the prior art papermaking fabric monofilament of polyester or polyamide is preferred.

Similarly to the warp, the weft may be formed of monofilament or a twisting of multi-filaments of synthetic resin. It is however preferred to use monofilament of polyester or polyamide solely or in combination with the ratio of the number in a range of 3:1 to 1:3.

The selection of the warp and weft mentioned above is determined in consideration of the types of the papermaking machine, the operating conditions, the properties of paper sheets to be manufactured and other factors.

Although the auxiliary weft may be made of filaments similar to the weft and the warp, monofilament of polyamide or polyester is preferred. Besides, twisting of multi-filaments is suited for the fabric for use in the application where importance is placed to the smoothness rather than the water drainage property.

Figure 2D:
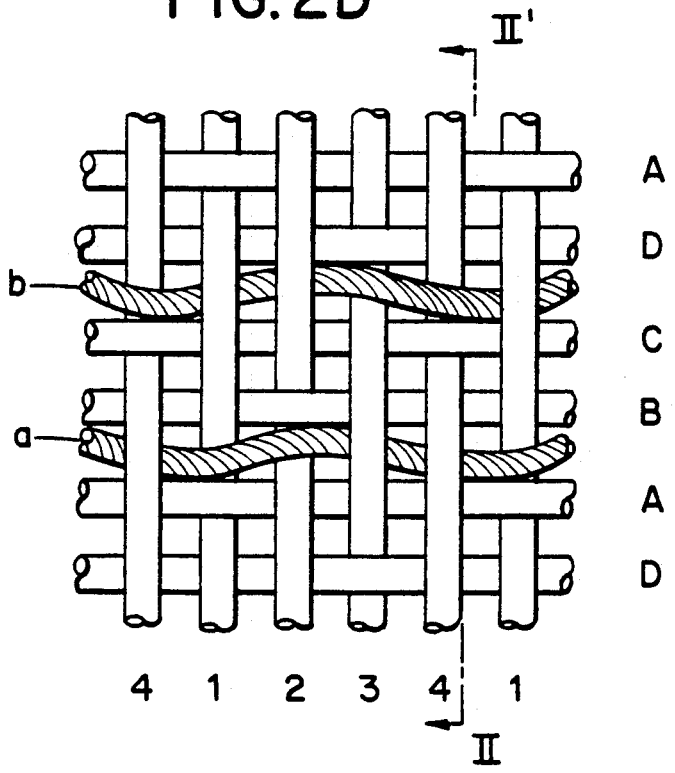
Figure 2E:
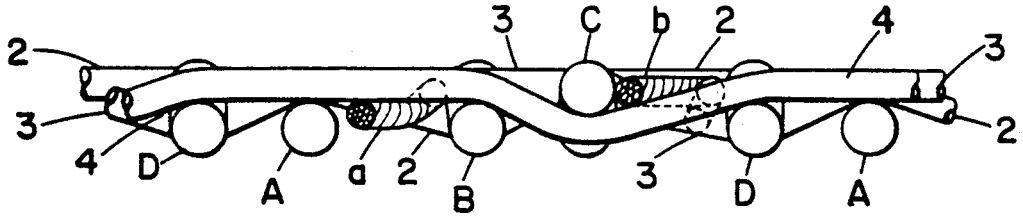

FIGS. 2D and 2E show the fabric wherein auxiliary wefts a and b are made of twisted multi-filaments, instead of monofilament auxiliary wefts shown in FIGS. 2B and 2C.

A plurality of the auxiliary warps and more specifically a pair of auxiliary warps may be woven into the texture in juxtaposition, which is preferred for the fabric having a relatively low density of wefts on the order of 35 wefts/inch or less.

Figure 2F:
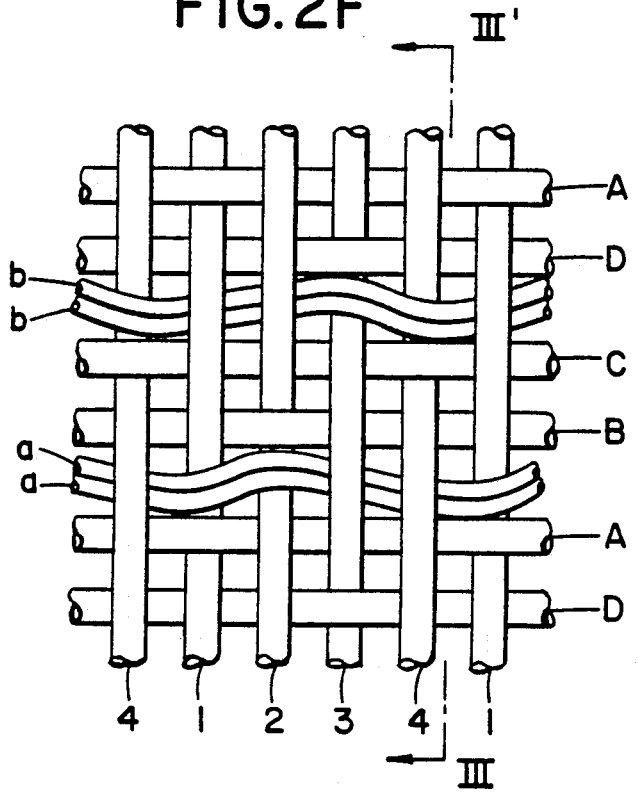
Figure 2G:
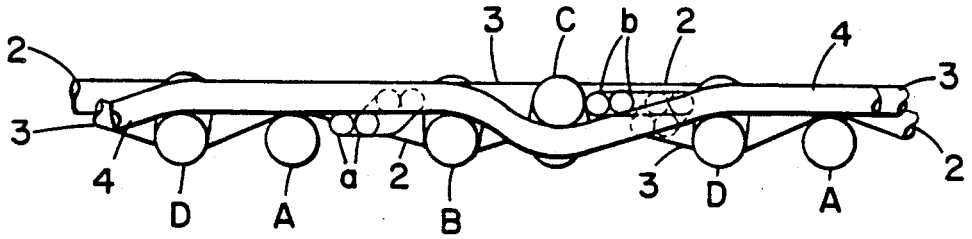

FIGS. 2F and 2G show the fabric wherein pairs of auxiliary wefts a,a and b,b are used, instead of single auxiliary wefts shown in FIGS. 2B and 2C.

Since the auxiliary weft is disposed at the intersection of two warps, is assumes a higher position than the warp underlying the weft.

In connection with the selection of the diameter of the auxiliary weft, it has generally been found that it should preferably be smaller than 60% of the weft, although it also depends on the diameter of the warp as used.

COMPARATIVE TEST

A fabric having the texture according to the invention shown in FIG. 2A and a prior art fabric having the texture shown in FIG. 1A were prepared with the compositions listed in the following table and tests for comparison were carried out, the results of which are also shown in the same table.

TABLE 1

| | TEXTURE | EXEMPLARY EMBODIMENT 1 3/1 BROKEN TWILL WEAVE + AUXILIARY WEFT | FABRIC FOR COMPARISON 1 3/1 BROKEN TWILL WEAVE |
|---|---|---|---|
| STRUCTURE OF | Warp material | PET monofilament | PET monofilament |
| | Diameter (mm) | 0.25 | 0.25 |
| | Density | | |

TABLE 1-continued

| | TEXTURE | EXEMPLARY EMBODIMENT 1 3/1 BROKEN TWILL WEAVE + AUXILIARY WEFT | FABRIC FOR COMPARISON 1 3/1 BROKEN TWILL WEAVE |
|---|---|---|---|
| FABRIC | (number/inch) | 58 | 58 |
| | Weft material | PET monofilament | PET monofilament |
| | Diameter (mm) | 0.27 | 0.30 |
| | Density (number/inch) | 40 | 42 |
| | Auxiliary weft material | PA monofilament | |
| | Diameter (mm) | 0.15 | |
| | Density (number/inch) | 20 | |
| ITEMS OF TEST | Pulp slurry drainage time (sec.) | 5.2 | 6.2 |
| | Retention of pulp (%) | 75 | 66 |
| | Bekk Smoothness (sec.) | 87 | 62 |

Notes

PET: Polyester.

PA: Polyamide.

Pulp slurry drainage time: Time taken by pulp slurry of 0.04% concentration containing 170 ml of freeness of defiberlized news paper having a water level of 300 mm until it is reduced to zero upon flowing down over fabric disposed with inclination of 15 relative to the vertical.

Retention of pulp: Ratio in weight of manufactured paper to charged pulp (in %).

Bekk Smoothness: Smoothing rate of paper sheet on the fabric side as measured by Bekk smoothness tester.

As will be appreciated from the description of the exemplary embodiments and the results of the test, the papermaking fabric according to the present invention is far improved over the prior art fabric in respect to the drainage capability, retention capability, smoothness and others.

By virtue of the structure of the fabric according to the present invention in which the longitudinal grooves formed by the long crimps of the warps in the papermaking surface of the fabric are substantially filled with the auxiliary wefts to prevent the fibers contained in the raw material slurry from being deposited in the groove, the dehydration property can be protected against degradation more satisfactorily. Consequently, the process for enforced dehydration under vacuum is rendered unnecessary with the desirable dehydration property being maintained from the early stages to the succeeding stages in the papermaking process. Further, the fabric is less susceptible to abrasion, whereby the use life thereof is correspondingly elongated.

Besides, since the non-uniformity of the inter-weft gaps is compensated for by the thin auxiliary wefts with the gap size being reduced, the quality of paper sheet as manufactured can be improved significantly.

Further, due to the filling of the recesses otherwise formed in the papermaking surface with the auxiliary wefts, improved smoothness of paper as manufactured, suppression of generation of the wire marks and sheet release and other advantageous effects can be obtained.

FIGS. 5 and 6 show knuckle mark patterns in the papermaking surface of the prior art fabric of 3/1 -broken-twill weave and a fabric of 3/1 broken-twill having the auxiliary wefts incorporated therein according to the teaching of the invention, respectively. From these figures, it can be seen that the fabric according to the invention has a far greater number of distributed points for supporting the paper fibers, which contributes to improvements of the qualities of manufactured paper in general and among others the smoothness of paper, suppression of the marks and the retention.

The fabric according to the invention is of a single layer structure having an essentially same thickness as that of the conventional fabric and can avoid the shortcomings such as high water containing capacity, re-adhesion, shower effect and others Thus, the fabric according to the invention can find its application for the manufacture of various kinds of paper sheets.

What is claimed is:

1. A papermaking single-layer fabric comprising a broken-twill woven fabric having a paper side and a running side formed of warps and primary and auxiliary wefts and having more than four shafts in each repeating unit, said running side formed of long crimped primary wefts, where in a repeating unit, an auxiliary weft, having a smaller diameter than the primary weft, is disposed between two of said primary wefts and over two adjacent warps at a location where one of two said adjacent warps extends from the paper side over one of said two primary wefts toward the running side to extend under the second of said two wefts and the second of said adjacent warps extends from the running side under said one of the two primary wefts toward the paper side over the second of said primary wefts, said two adjacent warps crossing each other between said two primary wefts, said auxiliary weft being woven at least once to be over said two adjacent warps and under the remaining warps in said unit.

2. A papermaking single-layer fabric as set forth in claim 1, wherein said broken-twill woven fabric having the running side formed of long crimps of primary wefts is of 3/1 satin weave, said auxiliary weft being disposed for every two other primary wefts.

3. A papermaking single-layer fabric as set forth in claim 1, wherein said broken-twill woven fabric having the running side formed of long crimps of primary wefts is of 4/1 broken-twill weave, and wherein three auxiliary wefts are disposed among five primary wefts in each repeating unit.

4. A papermaking single-layer fabric as set forth in claim 1, wherein the said broken twill-woven fabric having the running side formed of long crimps of primary wefts is 5/1 broken-twill weave, and wherein four auxiliary wefts are disposed among six primary wefts in each repeating unit.

5. A papermaking single-layer fabric as set forth in claim 1, wherein the broken-twill woven fabric of more than four shafts inclusive thereof and having the running side formed of long crimps of primary wefts comprises the primary wefts each formed of polyester monofilament.

6. A papermaking single-layer fabric as set forth in claim 1, wherein the broken-twill woven fabric of more than four shafts inclusive thereof having the running side formed of long crimps of primary wefts comprises the primary wefts each formed of polyamide monofilament.

7. A papermaking single-layer fabric as set forth in claim 1, wherein the broken-twill woven fabric of more than four shafts inclusive thereof and having the running side formed of long crimps of wefts comprises the primary wefts each formed of either polyester monofilament or polyamide monofilament.

8. A papermaking single-layer fabric as set forth in claim 7, wherein the ratio of numbers of the polyester monofilaments and the polyamide monofilaments forming the primary wefts, respectively, is in the range of 3:1 to 1:3.

9. A papermaking single-layer fabric as set forth in claim 1, wherein the auxiliary weft is formed of monofilament.

10. A papermaking single-layer fabric as set forth in claim 1, wherein the auxiliary weft is constituted by a plurality of monofilaments, each having a smaller diameter than the primary weft.

11. A papermaking single-layer fabric as set forth in claim 1, wherein the auxiliary weft is constituted by polyamide monofilament.

12. A papermaking single-layer fabric as set forth in claim 1 wherein said auxiliary weft is constituted by a twisting of multi-filaments.

* * * * *